US008575519B2

(12) United States Patent
Pianezze

(10) Patent No.: US 8,575,519 B2
(45) Date of Patent: Nov. 5, 2013

(54) ELECTRONIC GAS IGNITER DEVICE AND INTEGRATED BOX-LIKE TERMINAL BOARD FEATURING A CABLE CLAMP, IN PARTICULAR FOR ELECTRIC HOUSEHOLD APPLIANCES

(75) Inventor: Daniele Pianezze, Cassano Magnago (IT)

(73) Assignee: ITW Industrial Components S.R.L. con Unico Socio, Milan (IT)

( * ) Notice: Subject to any disclaimer, the term of this patent is extended or adjusted under 35 U.S.C. 154(b) by 1292 days.

(21) Appl. No.: 12/374,878

(22) PCT Filed: Oct. 18, 2007

(86) PCT No.: PCT/IB2007/003129

§ 371 (c)(1),
(2), (4) Date: Jan. 23, 2009

(87) PCT Pub. No.: WO2008/047222

PCT Pub. Date: Apr. 24, 2008

(65) Prior Publication Data

US 2010/0020507 A1 Jan. 28, 2010

(30) Foreign Application Priority Data

Oct. 20, 2006 (IT) ..... TO2006A0758

(51) Int. Cl.

| | |
|---|---|
| ***F23Q 7/00*** | (2006.01) |
| ***F23Q 7/22*** | (2006.01) |
| ***H01J 5/00*** | (2006.01) |
| ***H01J 15/00*** | (2006.01) |
| ***H02G 3/08*** | (2006.01) |
| ***H05K 5/00*** | (2006.01) |
| ***H05K 5/06*** | (2006.01) |

(52) U.S. Cl.

USPC ..... 219/260; 219/267; 219/268; 174/50; 174/50.5; 174/50.51; 174/50.52; 361/730

(58) Field of Classification Search

USPC ..... 123/179.5, 179.6, 143 R–143 C; 361/728, 729–747; 99/419–421 V; 219/260–270

See application file for complete search history.

(56) References Cited

U.S. PATENT DOCUMENTS

| | | | | |
|---|---|---|---|---|
| 3,027,444 | A * | 3/1962 | Weeks | 126/273 R |
| 5,013,872 | A * | 5/1991 | Lockwood et al. | 174/663 |
| 6,365,831 | B1 * | 4/2002 | Rupp et al. | 174/50 |
| 6,796,792 | B1 * | 9/2004 | Aleardi et al. | 431/258 |
| 6,933,471 | B2 * | 8/2005 | Hamel et al. | 219/270 |
| 7,675,005 | B2 * | 3/2010 | Annavarapu et al. | 219/270 |
| 7,772,525 | B2 * | 8/2010 | Annavarapu et al. | 219/260 |
| 7,785,482 | B2 * | 8/2010 | Subramanian et al. | 216/16 |
| 2007/0068940 | A1 * | 3/2007 | Gates | 220/3.94 |
| 2009/0179023 | A1 * | 7/2009 | Annavarapu et al. | 219/260 |
| 2011/0253696 | A1 * | 10/2011 | Hanagan et al. | 219/260 |

FOREIGN PATENT DOCUMENTS

| | | | |
|---|---|---|---|
| AT | 396635 | B | 10/1993 |
| DE | 20114751 | U1 | 11/2001 |
| EP | 1101067 | B1 | 3/2003 |
| FR | 2212516 | A1 | 7/1974 |
| FR | 2569501 | * | 2/1986 |
| FR | 2569501 | A1 | 2/1986 |
| GB | 2280551 | A | 2/1995 |
| GB | 2280551 | * | 2/2013 |
| JP | 60142117 | A | 7/1985 |
| RU | 2068157 | C1 | 10/1996 |
| RU | 2271499 | C2 | 3/2006 |
| WO | 2005093325 | A1 | 10/2005 |
| WO | 2006093475 | A1 | 9/2006 |

OTHER PUBLICATIONS

ISR for PCT/IB2007/003129 dated Apr. 3, 2008.
Office Action for RU2009118936/06 mailed Jan. 11, 2011.

* cited by examiner

*Primary Examiner* — Quang Van
*Assistant Examiner* — Michael Hoang
(74) *Attorney, Agent, or Firm* — Lowe Hauptman & Ham, LLP

(57) ABSTRACT

A gas igniter device includes a first synthetic material casing containing igniter and an electronic control and a terminal board integrally coupled to the first casing and in turn including a cable clamp. The terminal board includes a second synthetic box-shaped material casing including: a cup-shaped body provided with a first and a second opposite side opening and an inlet oriented essentially perpendicular to the side openings; and a closing lid of the inlet hingedly restrained onto a first side of the cup-shaped body; a first end of the first casing is provided with a pair of electric power contacts for the igniter and is snappingly and removably coupled in use to the cup-shaped body within a first side opening with the contacts arranged inside the cup-shaped body in position facing the inlet. The lid is snappingly coupling to a second side of the cup-shaped body and provided with a first clamp for an electric power cable insertable in use through the second side opening; a second clamp joined to the first being integrally carried by a bottom wall of the cup-shaped body in addition to a third clamp adjacent to the second side opening.

8 Claims, 3 Drawing Sheets

ELECTRONIC GAS IGNITER DEVICE AND INTEGRATED BOX-LIKE TERMINAL BOARD FEATURING A CABLE CLAMP, IN PARTICULAR FOR ELECTRIC HOUSEHOLD APPLIANCES

RELATED APPLICATIONS

The present application is based on International Application Number PCT/IB2007/003129 filed Oct. 18, 2007, and claims priority from, Italian Application Number TO2006A000758, filed Oct. 20, 2006, the disclosures of which are hereby incorporated by reference herein in their entirety.

TECHNICAL FIELD

The present invention relates to an electronic gas igniter device in which a box-like terminal board forming a cable clamp is integrated. The device of the invention is particularly useful for equipping electric household appliances, such as gas-fed stoves and/or barbecue ranges and/or cooking ranges.

BACKGROUND ART

It is known from EP1101067B1 by the Applicant an electronic gas igniter device in which there is integrated a box-like terminal board accommodating the electric power contacts therein, to which the terminals of an electric power cable are coupled in use; according to such embodiment, the box-like terminal board, possibly provided with a removable lid and a traditional wedge-shaped cable clamp device for the power cable, operated by means of screw, forms a single casing formed by non-conducting material with a cup-shaped body which accommodates igniter means composed by at least one secondary winding of a transformer and by electric contacts of the faston type connectable in use, in a known manner, to ignition electrodes of the burners of an electric household appliance, e.g. a cooking range, for feeding high-voltage electric impulses for generating sparks adapted to cause the ignition of the burners themselves.

The part of casing forming the terminal board contains therein electronic control means of the igniter means and the power contacts are directly wired to these and to the igniter means inside the device, so as to simplify the assembly operations to the greatest extent. Finally, a ground contact extends in a cantilevered way from the box-shaped part of the casing so that, when the same is fixed, usually by snapping means, to an electrically conductive part of the electric household appliance, it comes into contact with such conductive part, thus forming the grounding of the conductive part itself, usually formed by the cooking range.

The above-described known device is more than satisfactory. However, electric household appliance manufacturers are currently searching for an alternative solution which, on the one hand, may further simplify the assembly operations and which, on the other hand, may reduce the total cost of the device.

Furthermore, it is currently felt the need to allow, during maintenance, the replacement of the terminal board portion of the device independent from the replacement of the portion containing the igniter means (and vice versa), without affecting the possibility of handling on the assembly line and of assembling the two portions of the device as a single unit.

DISCLOSURE OF INVENTION

It is thus the object of the present invention to improve the gas igniter device known from EP1101067B1 in order to satisfy the above-described current needs of electric household appliance manufacturers without affecting the advantages related to the previously known gas igniter device.

The present invention thus relates to an electronic gas igniter device for an electric household appliance, such as for example a cooking range, such a gas igniter device integrating a terminal board and defined as in claim 1.

In particular, the electronic gas igniter device according to the invention is of the type comprising a first casing made of electrically non-conducting material and carrying igniter means for the burners of a cooking range or barbecue of an electric household appliance, electronic control means of the igniter means, and a terminal board integrally coupled to the first casing and in turn comprising cable clamp means.

"Integral" and "integrally" hereinafter mean an integral connection which allows to handle the coupled elements, e.g. the first casing and the terminal board, as a single part, without necessarily meaning that the two coupled elements are actually obtained from a single part.

Therefore, according to an aspect of the invention, the terminal board comprises a second, box-like casing made of electrically non-conducting material as a self-bearing element, independent from the first casing; the second casing comprises: a cup-shaped body provided with a first and a second opposite side opening and an inlet oriented essentially perpendicular to the side openings; and a lid adapted to close the inlet; a first end of the first casing is provided with a pair of electric power contacts for the igniter means and is adapted to be coupled through the first side opening of the cup-shaped body so as to be, preferably snappingly, integrally yet removably restrained in use to the same, so that the pair of power contacts is in use arranged within the cup-shaped body, in a position facing the inlet, to define, with the second casing, said terminal board.

In particular, the lid is hingedly restrained to a first side of the cup-shaped body adjacent to the side openings and is adapted to be snappingly coupled to a second side of the cup-shaped body, opposite to the first; the lid is provided with first clamping means for an electric power cable insertable in use in the cup-shaped body through the second side opening; and the first clamping means mate in use with second clamping means, joined to the first, integrally carried by a bottom wall of the cup-shaped body opposite to the inlet; third clamping means for the electric cable are integrally carried by the bottom wall in position immediately adjacent to the second side opening.

In this manner, the first and second casing may be handled as a unit, with the advantage of obtaining an igniter device which integrates a terminal board, as in the previously known device, and of being able to preassemble the power cable in the terminal board before assembling the gas igniter device on the electric household appliance. However, in the case of maintenance intervention, it is possible to replace the damaged component only (terminal board or electronic circuitry) carried by (particularly within) the first casing; above all, it is further possible for the manufacturer of the gas igniter device to handle the first casing alone, without terminal board, on the assembly lines on/in the same of the igniter and control means, with considerable cost saving and reduction of the overall volume of the assembly lines themselves, coupling the second casing to the first only at the end and thus finally creating the terminal board. If so required by the electric household appliance manufacturer, the first and the second casing may even by supplied as two separate parts, with different codes, which will be assembled by the electric household appliance manufacturer to obtain the complete device of the invention only before wiring the power cable and assembling on the electric household appliance.

Finally, the lid practically acts as a cable clamp device integrated in the terminal board, reducing the volumes of the terminal board and allowing a screwless assembly, except for those markets in which at least one screw is however required by safety standards.

BRIEF DESCRIPTION OF THE DRAWINGS

Further features and advantages of the invention will be apparent from the following description of a non-limitative embodiment thereof, with reference to the figures in the accompanying drawings, wherein.

BEST MODE FOR CARRYING OUT THE INVENTION

With reference to the aforesaid figures, numeral 1 indicates as a whole an electronic gas igniter device for an electric household appliance, in particular a cooking range or barbecue, known and not shown for the sake of simplicity.

Figure 1:
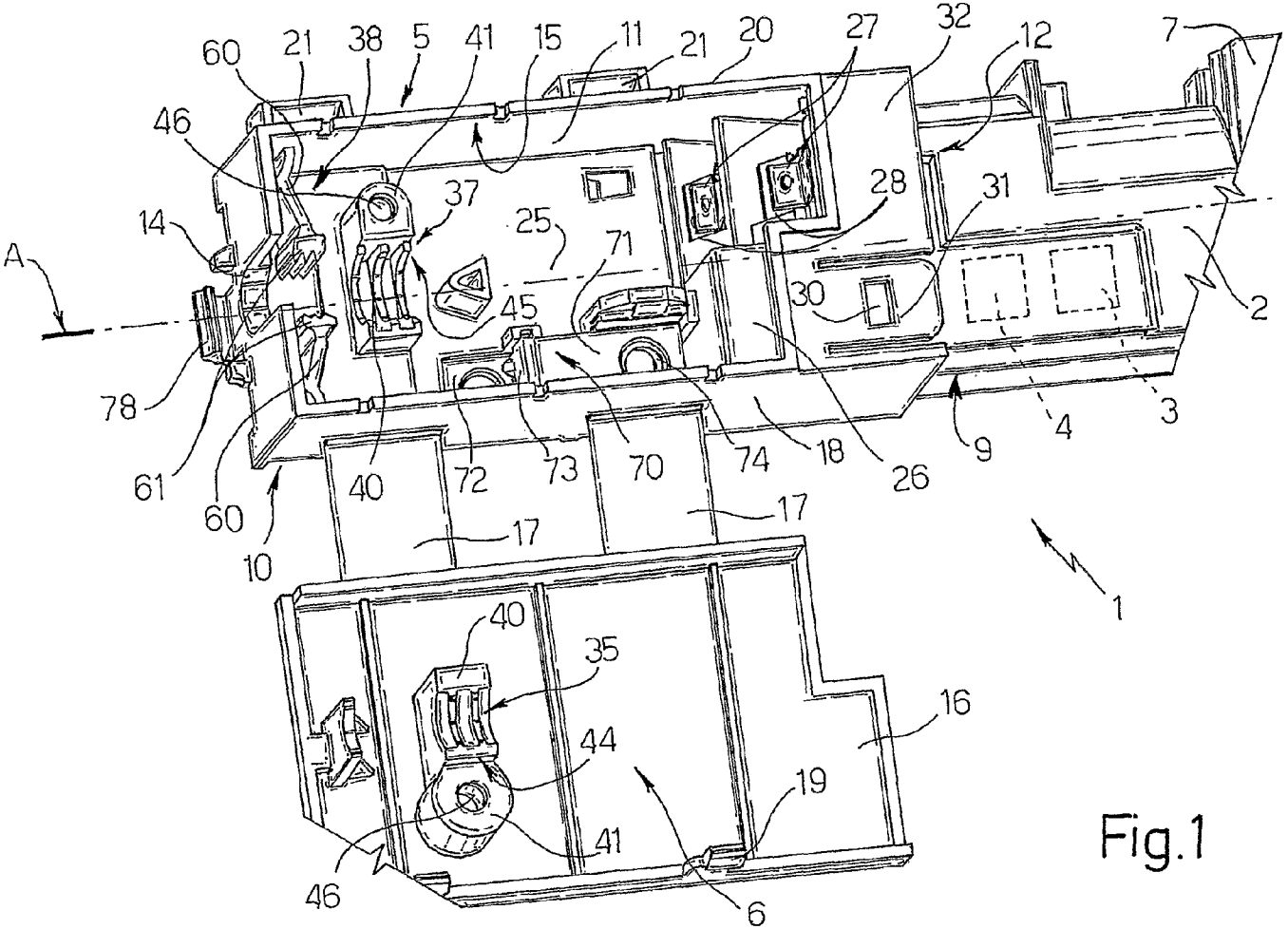
FIG. 1 shows a top three-quarters perspective view of an electronic gas igniter device made according to the invention and shown in a pre-assembly configuration.
Figure 3:
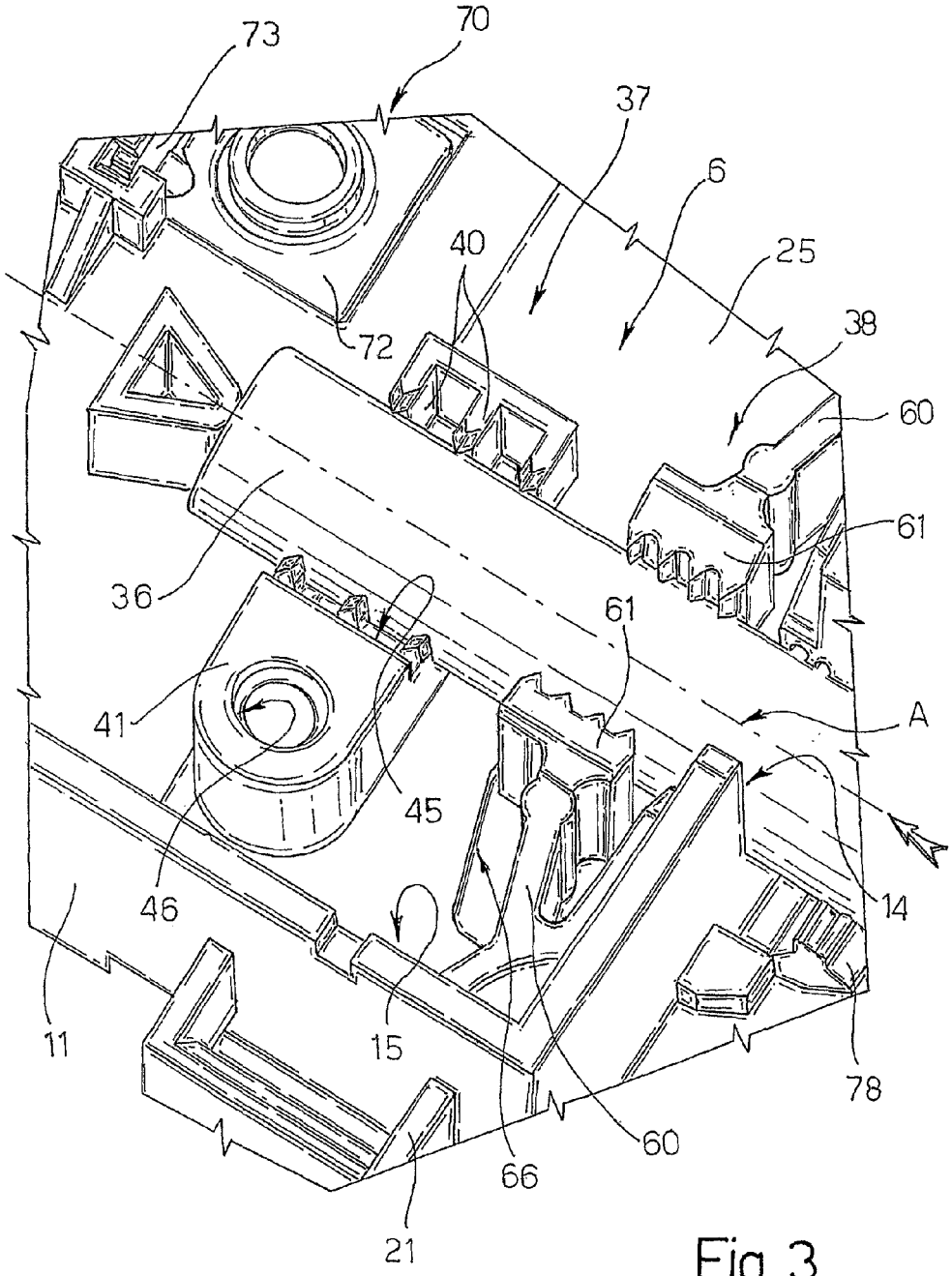

The gas igniter device 1 is of the type comprising: a first casing 2 made of electrically non-conducting material and carrying, in a known manner, igniter means 3 and electronic control means 4, both known and diagrammatically shown by a broken line as one block (FIG. 1); and a terminal board 5 integrally coupled to the first casing 2 and in turn comprising cable clamp means, indicated as a whole by numeral 6 (FIGS. 1 and 3). The casing 2 is defined by an essentially cigar-like cup-shaped body and is provided with a plurality of stacks 7 for corresponding high-voltage output contacts (known and not shown) and it is well known in the art, and therefore shown truncated for the sake of simplicity, and contains the igniter means 3 therein (including, for example, the aforesaid high-voltage output contacts and at least the secondary winding of a transformer) and, according to a first aspect of the invention, also the electronic control means 4 of the latter, usually consisting of an electronic board powered at low voltage and which, in the state of the art is preferably mounted in the terminal board 5.

The igniter and control means 3, 4, or at least part thereof, are embedded in an insulated resin which is poured into an opening 9 of the casing 2 (thus closing the same) after the assembly of the means 3 and 4 and is then hardened by polymerisation.

Figure 2:
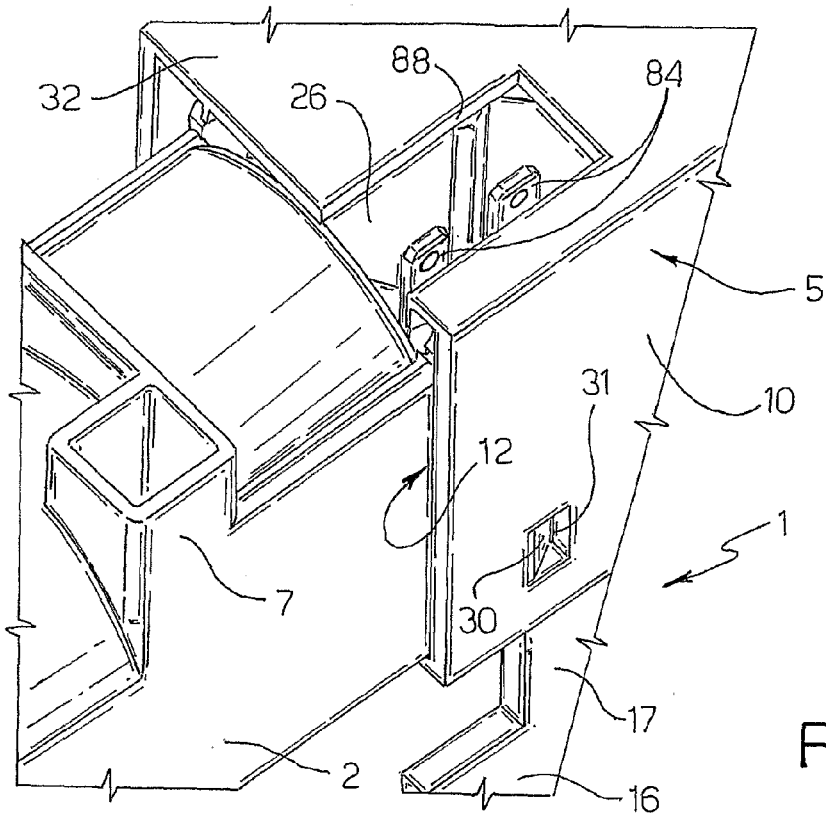
FIGS. 2, 3 and 4 show perspective views on an enlarged scale of corresponding constructive details of the device in FIG. 1.

According to the invention, the terminal board 5 comprises a second box-like casing 10 made of electrically non-conducting material as a self-bearing element, independent from the first casing 2; in particular, the second casing 10 comprises: a cup-shaped body 11 provided with a first side opening 12 (FIGS. 1 and 2), a second side opening 14 (FIGS. 1 and 3), opposite to the first, and an inlet 15 oriented essentially perpendicular to the side openings 12 and 14; and a lid 16 shaped so as to be adapted in use to close the inlet 15, hingedly restrained by means of elastically or plastically deformable tongues 17, onto a first side 18 of the cup-shaped body 11 adjacent to the side openings 12, 14 and adapted to snappingly couple, e.g. by means of elasticising teeth 19 essentially of known type, to a second side 20 of the cup-shaped body 11, opposite to side 18 and provided with reception means for the teeth 19, e.g. constituted by eyelets 21 obtained integrally in one piece with the cup-shaped body 11.

In this manner, the cup-shaped body 11 and the lid 16 constituting the casing 10 may be integrally obtained in one piece. In practice, the casings 2 and 10 are formed by a synthetic plastic material and are obtained by injection moulding, as two independent and separate parts, the casing 10 being moulded with the lid 16 in the open configuration shown in the figures, in which it lays essentially parallel to and nearly coplanar with a bottom wall 25 of the cup-shaped body 11, arranged facing the inlet 15, and on opposite band to the same.

According to an aspect of the invention, a first end 26 (FIGS. 1 and 2) of the casing 2 is provided with a pair of electric power contacts 27 (FIG. 1) for the igniter means 3, e.g. formed by faston type L-shaped foil connectors, snappingly coupled in appropriate seats 28 obtained on the end 26 of the casing 2.

The end 26 is then shaped so as to be adapted in use to throughly couple into the first side opening 12 of the cup-shaped body 11 so as to be in use integrally yet removably and preferably snappingly restrained (e.g. by means of elasticising teeth 30 of the casing 2 connectable in through windows 31 of one end 32 of the cup-shaped body 11 closed as a box towards the inlet 15, with the cup-shaped body 11 itself.

In this manner, also the entire casing 2 is restrained in "integral", yet removable manner to the cup-shaped body 11; furthermore, the end 26, the opening 12 and the cup-shaped body 11 are shaped so that, when end 26 is throughly coupled in the opening 12 and well into the cup-shaped body 11, the pair of power contacts 27 is arranged inside the cup-shaped body 11 itself, in a position facing the inlet 15, as shown in FIG. 1, to define, along with the second casing 10 as a whole, the terminal board 5.

According to a further aspect of the invention, the lid 16 is provided with first clamping means 35 for an electric power cable 36 (FIG. 3) insertable in use in the cup-shaped body 11 through the second side opening 14; the first clamping means 35 mate in use with second clamping means 37, joined to the first, integrally carried in one piece by the bottom wall 25 of the cup-shaped body 11 opposite to the inlet 15; finally, third clamping means 38 for the electric cable 36 are integrally carried in one piece by the bottom wall 25 in a position immediately adjacent to the second side opening 14. In this manner, the mentioned cable clamp means 6 are defined, according to this aspect of the invention, by the lid 16 itself, when (e.g. after bending the tongues 17 as a U) this is in a snappingly coupling configuration (by means of the teeth 19 and the eyelets 21) with the cup-shaped body 11, in which the inlet 15 is closed (position not shown for the sake of simplicity); and from the bottom wall 25 of the cup-shaped body 11, along with the first, second and third clamping means, 35, 37 and 38 respectively.

The latter, in particular, are shaped so as to determine in use on the lid 16, when it is in said snappingly coupling configuration with the cup-shaped body 11, an elastic reaction so as to stress the respective snappingly locking means of the lid 16 on the cup-shaped body 11 consisting of the teeth 19 coupled in the eyelets 21.

For this purpose, the first and the second clamping means, 35 and 37 respectively, are each defined by corresponding first cantilevered projections 40, having a saddle-shaped free end, and by second cantilevered projections 41, having flat free end, both integrally made in one piece with an internal face (i.e. facing in use towards the inlet 15) of the lid 16 and with the bottom wall 25 of the cup-shaped body 11 transversally to an axis A joining the side openings 12, 14 of the cup-shaped body 11 and in use essentially coinciding with the symmetry axis of the power cable 36.

When the lid is in the mentioned snappingly coupling configuration, the first projections 40 are arranged facing and adjacent to each other and the second projections 41 are coupled in reciprocal contact; between the projections 40 and the corresponding projections 41 of the lid 16 and, respectively, of the bottom wall 25 of the cup body 11, there are further defined first steps 44 and, respectively, second steps 45 joined together and oriented parallelly to the axis A, which, in the snappingly coupling configuration of the lid 16, are reciprocally engaged to prevent associated side movements between the lid 16 and the cup-shaped body 11.

Preferably, the second protrusions 41 are provided with respective holes 46 oriented in use perpendicularly to the bottom wall 25 of the cup-shaped body 11 and reciprocally coaxial, adapted to optionally receive, when this is required by standards, a clamping screw (known and not shown) of the lid 16 on the cup-shaped body 11. It should be underlined that, due to the described structure, the lid 16 is alone more than sufficient to exert on the cable 36 the action of cable clamp with the pull loads required by standards, and therefore the possible screw is not required.

This is also due to the fact that, in order to further improve the clamping action on the cable 36, the third additional clamping means 38 consist in a pair of elastically deformable arms 60 which extend in a cantilevered and oblique way within the cup-shaped body 11, flanking on opposite band with their respective enlarged and notched free ends 61 the second side opening 14 in the direction of introduction of the power cable 36 within the same; the arms 60 project from the second side opening 14 towards the first and second clamping means 35, 37, which are arranged, with respect to the direction of introduction defined by the axis A (and by the sense of the arrow in FIG. 3), downstream of the third clamping means 38.

Figure 4:
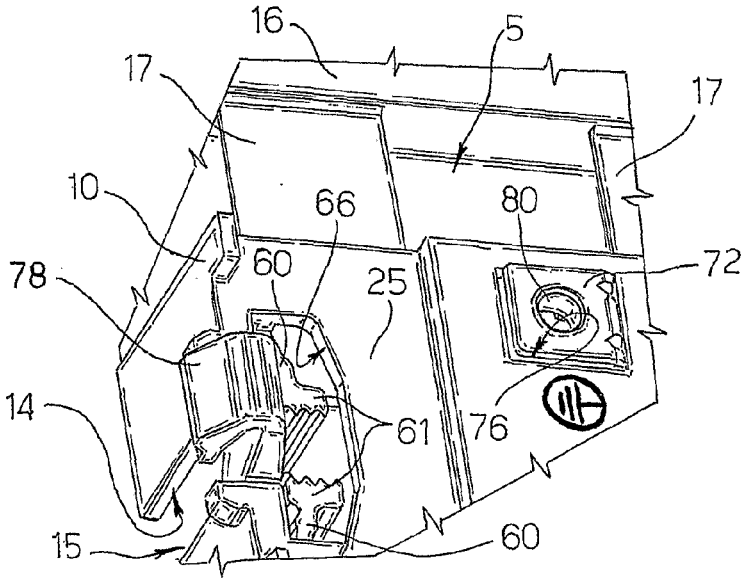

In order to make the arms 60 in a single moulding operation together with the cup-shaped body 11 and the lid 12, at the arms 60 the bottom wall 25 is provided with a through window 66 (FIGS. 3 and 4).

According to a further aspect of the invention, the terminal board 5 comprises a ground contact 70 made of a metallic foil Z-folded and integrally carried by the bottom wall 25 of the cup-shaped body 11; the ground contact 70 includes a first wing 71 and a second wing 72, arranged parallelly to the bottom wall 25, and an intermediate portion 73 joining the first and the second wing, 71 and 72 respectively, arranged essentially perpendicularly to the same; the first wing 71 is snappingly fastened against the bottom wall of the cup-shaped body 25, in a position facing the inlet 15 of the same, and is provided with locking means for a ground terminal (known and not shown for the sake of simplicity) of the electric power cable 36, e.g. constituted by a seat 74 for a fastening screw (known and not shown); and the second wing 72 projects in a cantilevered way from the cup-shaped body 11 (FIG. 4), from opposite band to the lid 16, through a through opening 76 made in the bottom wall 25 of the cup-shaped body 11; finally, at least the latter being provided, in the part of the second wing 72, with known fastening means 78, preferably of the snapping type, of the igniter device 1 to the electric household appliance, e.g. the mentioned cooking range or barbecue, made so that the second wing 72 is locked in use between the second casing 10 and the cooking range or barbecue, in close contact against the latter, to allow the connection to ground of the same, possibly also through a fastening screw insertable in a through hole 80 of the second wing 72.

Finally, the first casing 2 carries on its first end 26 and laterally to the electric power contacts 27, respective connection contacts 84 (FIG. 2) to the electronic control means 4, which are accommodated within the casing 2, along with the igniter means 3, as previously seen; in this case, the second casing 10 is provided, on a side wall of the cup-shaped body 11 adjacent to the side opening 12 and at the end 32 closed as a box towards the inlet 15, with a through cutout 88 which accommodates in use, when the casing 2 is coupled to the casing 10 through the opening 12, the contacts 84 for forming a standard connector allowing the connection of the electronic control means 4 to a catenary of control switches for the device 1, e.g. integrated in the gas supply control taps to the burners.

The invention claimed is:

1. An electronic gas igniter for an electric household appliance, comprising:

a first casing made of electrically non-conducting material;

an igniter, an electronic control device, and a terminal board all integrally connected to said first casing; said first casing further comprising a cable clamp apparatus;

wherein the terminal board comprises a second box-like casing made of electrically non-conducting material independent of the first casing;

said second casing further comprising a cup-shaped body having first and second opposite side openings and an inlet oriented substantially perpendicular to said first and said second opposite side openings, and a lid dimensioned and configured to close the inlet;

said first casing having a first end including a pair of electric power contacts for the igniter and being coupled through said first side opening of said cup-shaped body so as to be removably snap-secured in use, said pair of electric power contacts being arranged within the cup-shaped body in a position facing said inlet to define said terminal board with the second casing, and wherein the lid is hingedly restrained to a first side of the cup-shaped body adjacent to said side openings and is adapted to be snap-coupled to a second side of the cup-shaped body opposite the first side, and wherein a first and a second clamping apparatus each defined by corresponding first cantilevered projections having a saddle-shaped free end, and by second cantilevered projections, having a flat free end, and wherein the first clamping apparatus is integrally made in one piece with said cup-shaped body and said second clamping apparatus is integrally made in one piece with said lid; and, wherein said first casing carries on said first end and laterally to said electric power contacts respective connection contacts to said electronic control device, which are accommodated within the first casing, along with said igniter; said second casing being provided, on a side wall of the cup-shaped body adjacent to said first side opening of the same with a through cutout which accommodates in use, when the first casing is coupled to the second through said first side opening, said connection contacts to said electronic control device.

2. An electronic gas igniter for an electric household appliance, comprising:

a first casing made of electrically non-conducting material;

an igniter, an electronic control device, and a terminal board all integrally connected to said first casing; said first casing further comprising a cable clamp apparatus;

wherein the terminal board comprises a second box-like casing made of electrically non-conducting material independent of the first casing;

said second casing further comprising a cup-shaped body having first and second opposite side openings and an inlet oriented substantially perpendicular to said first and said second opposite side openings, and a lid dimensioned and configured to close the inlet;

said first casing having a first end including a pair of electric power contacts for the igniter and being coupled through said first side opening of said cup-shaped body so as to be removably snap-secured in use, said pair of electric power contacts being arranged within the cup-shaped body in a position facing said inlet to define said terminal board with the second casing, and wherein the lid is hingedly restrained to a first side of the cup-shaped body adjacent to said side openings and is adapted to be snap-coupled to a second side of the cup-shaped body opposite the first side, and wherein a first and a second clamping apparatus each defined by corresponding first cantilevered projections having a saddle-shaped free end, and by second cantilevered projections, having a flat free end, and wherein the first clamping apparatus is integrally made in one piece with said cup-shaped body and said second clamping apparatus is integrally made in one piece with said lid; and, wherein said electrically non-conducting material is a synthetic plastic material; said first and second casings are injection moulded with said synthetic plastic material as two separate reciprocally independent elements.

3. An electronic gas igniter for an electric household appliance, comprising:

a first casing made of electrically non-conducting material;

an igniter, an electronic control device, and a terminal board all integrally connected to said first casing; said first casing further comprising a cable clamp apparatus;

wherein the terminal board comprises a second box-like casing made of electrically non-conducting material independent of the first casing;

said second casing further comprising a cup-shaped body having first and second opposite side openings and an inlet oriented substantially perpendicular to said first and said second opposite side openings, and a lid dimensioned and configured to close the inlet;

said first casing having a first end including a pair of electric power contacts for the igniter and being coupled through said first side opening of said cup-shaped body so as to be removably snap-secured in use, said pair of electric power contacts being arranged within the cup-shaped body in a position facing said inlet to define said terminal board with the second casing, and wherein the lid is hingedly restrained to a first side of the cup-shaped body adjacent to said side openings and is adapted to be snap-coupled to a second side of the cup-shaped body opposite the first side;

wherein said lid comprises a first clamping apparatus disposed on an inner face thereof and configured to receive an electric power cable insertable in the cup-shaped body through said second side opening;

a second clamping apparatus integrally disposed on a bottom wall of said cup-shaped body opposite the inlet, wherein said first clamping apparatus and said second clamping apparatus complementarily sit on top of one another when said lid is in a closed position; and, a third clamping apparatus integrally disposed on said bottom wall and positioned immediately adjacent to said second side opening on one side and said second clamping member on the opposite side.

4. The electronic gas igniter of claim 3, wherein said clamping apparatus is defined by said lid when in a snap-coupled configuration with the cup-shaped body closing said inlet; by said bottom wall of the cup-shaped body; and by said first clamping apparatus, said second clamping apparatus, and said third clamping apparatus being shaped so as to determine on said lid, when they are in said snap-coupled configuration with the cup-shaped body, an elastic reaction so as to stress respective snap-lock the lid on the cup-shaped body.

5. The electronic gas igniter of claim 4, wherein said first clamping apparatus and said second clamping apparatus are defined by respective first cantilevered projections having a saddle-shaped free end, and by second cantilevered projections having flat free end, both integrally made with an internal face of the lid and with said bottom wall of the cup-shaped body transversally to an axis (A) joining said side openings of the cup-shaped body and so that, when the lid is in said snap-coupled configuration, the first are facing and adjacent to each other and the second are coupled in reciprocal contact; between the first and second projections of the lid and, respectively, of the bottom wall of the cup body, being defined first and, respectively, second steps joined together and oriented parallel to said axis joining the side openings, which steps, in the snappingly coupled configuration of the lid, are reciprocally engaged to prevent relative side movements between the lid and the cup-shaped body.

6. The electronic gas igniter of claim 5, wherein said second projections include a plurality of holes oriented in use perpendicularly to said bottom wall of said cup-shaped body and reciprocally coaxial, and adapted to receive a clamping screw of the lid on the cup-shaped body.

7. The electronic gas igniter of claim 3, wherein said third clamping apparatus comprises a pair of elastically deformable arms which extend in a cantilevered and oblique way within the cup-shaped body, flanking on opposite band with their respective enlarged and notched free ends said second side opening in the direction of introduction (A) of said power cable within the same; said arms projecting from the second side opening towards the first and second clamping apparatus, which are arranged, with respect to said direction of introduction, downstream of the third clamping apparatus.

8. The electronic gas igniter of claim 3, wherein said terminal board comprises a ground contact made of a metallic foil Z-folded and integrally carried by said bottom wall of the cup-shaped body; the ground contact including a first and a second wing, arranged parallel to the bottom wall and an intermediate portion joining the first and the second wing and essentially arranged perpendicularly to the same; the first wing being snap-fastened against the bottom wall of the cup-shaped body, in a position facing the inlet of the same, and being provided with locking device for a ground terminal of an electric power cable insertable in use in the cup-shaped body through said second side opening; and the second wing projecting in a cantilevered way from the cup-shaped body, from opposite band to the lid, through a through opening made through the bottom wall of the cup-shaped body; at least the latter being provided, in the part of the second wing, with fastening snap apparatus, of the igniter to said appliance so that said second wing is locked in use between the second casing and the appliance in close contact to allow for connection to ground.

* * * * *